United States Patent [19]

Watanabe

[11] 4,326,355

[45] Apr. 27, 1982

[54] TOY SIMULATING STEAM LOCOMOTIVE, AND WHISTLE

[75] Inventor: Saburo Watanabe, Gardena, Calif.

[73] Assignee: Tomy Kogyo, Co., Inc., Tokyo, Japan

[21] Appl. No.: 116,904

[22] Filed: Jan. 30, 1980

[51] Int. Cl.[3] ..... A63H 33/26; G10K 5/00; G10K 9/10

[52] U.S. Cl. ..... 46/44; 46/232; 46/251; 46/191

[58] Field of Search ..... 46/230, 231, 248, 249, 46/251, 111, 112, 113, 44, 174, 175 R, 178, 179, 189, 190, 191, 1 R, 14; 40/428, 454; 272/8 F; 116/58 R, 58 A, 137 R, 140, 144

[56] References Cited

U.S. PATENT DOCUMENTS

| | | | |
|---|---|---|---|
| 503,610 | 8/1893 | Mackintosh . | |
| 1,180,524 | 4/1916 | Overholt . | |
| 1,599,736 | 9/1926 | Wright | 46/113 |
| 1,608,142 | 11/1926 | Stephenson | 46/112 |
| 1,720,394 | 7/1929 | Gatchet | 46/113 X |
| 1,732,036 | 10/1929 | Arthur . | |
| 1,753,127 | 4/1930 | Macklin . | |
| 2,076,145 | 4/1937 | Hall | 46/113 |
| 2,123,664 | 7/1938 | Schumacher | 116/58 R |
| 2,688,302 | 9/1954 | Desmond | 116/137 R X |
| 2,814,906 | 12/1957 | Orvis | 46/248 X |
| 2,915,312 | 11/1959 | Barthel | 272/53.2 |
| 3,073,060 | 1/1963 | Veris | 46/177 |
| 3,078,618 | 2/1963 | Hough et al. | 46/177 |
| 3,094,972 | 6/1963 | Leavenworth | 116/137 R |
| 3,095,201 | 6/1963 | Ryan et al. | 274/26 |
| 3,121,293 | 2/1964 | Sperry et al. | 46/175 R |
| 3,132,864 | 5/1964 | Glass et al. | 273/127 |
| 3,160,860 | 1/1965 | Glass et al. | 46/111 |
| 3,286,396 | 11/1966 | Ryan | 46/232 |
| 3,302,954 | 2/1967 | Elwell | 280/11.9 |
| 3,797,163 | 3/1974 | McRoskey et al. | 46/248 X |
| 4,157,826 | 6/1979 | Sims et al. | 46/189 |

*Primary Examiner*—F. Barry Shay
*Attorney, Agent, or Firm*—K. H. Boswell; Edward D. O'Brian

[57] ABSTRACT

A toy steam locomotive is described which includes a small electric motor which drives an apparatus for producing a sound simulating a steam locomotive, an apparatus for producing a sound simulating a steam locomotive whistle, and an apparatus for producing a visual simulation of a fire in a steam locomotive firebox. The apparatus for producing a simulated steam locomotive sound includes a resonator and a vibrating spring. A cycling member is attached to the spring and concurrently tenses and relaxes, lengthens and shortens and associates and disassociates said spring with a sound activating member. The apparatus for producing the sound simulating a steam locomotive whistle includes a housing having a fan located therein and an air inlet and air outlet. The air outlet is associated with a whistle and a sealing member seals the air inlet, but allows air to be drawn into the housing when the sealing member moves away from the air inlet. The apparatus for producing a visual simulation of a fire includes a flat transparent member having a plurality of ridges on one of its planar surfaces and a movable member located behind the transparent member. The movable member oscillates back and forth such that at least a two colored flame-like pattern on its surface is distorted by the ridges of the transparent member simulating a fire.

16 Claims, 12 Drawing Figures

30
34
32
26
50
38
40
44
42
36
56
54
52
46
48

186
76
78
192
196
194
232
234
82
108
206
198
230
224
220
218
62
22
190
226
222
188
64
66
202
234
204
228

TOY SIMULATING STEAM LOCOMOTIVE, AND WHISTLE

BACKGROUND OF THE INVENTION

A toy steam locomotive is described which has the capability of producing sounds simulating both the steam locomotive itself and the whistle sound associated with old-time steam locomotives. Also included is a simulated firebox which has the visual appearance of having a fire located therein.

A multiplicity of toys are known where it is considered advantageous to incorporate in the toy a mechanism producing an audible stimulation. Equally important in toys is, of course, the visual appearance of the toy to the child. In the category combining both visual and audio stimulation, there are, of course, talking dolls and toy cars which produce internal combustion engine sounds.

In U.S. Pat. No. 3,286,396 some of the problems associated with the mimicking of a natural sound are described. In this particular U.S. patent the inventors sought to mimick the sound of an automobile engine and associated sounds such as sirens and the like.

Old-time steam locomotives had particular sounds associated with them which were unique to them and served to identify the steam locomotive simply by the sounds. The whistle of the locomotive had a characteristic sound which was produced by the use of high pressure steam. Normally when the locomotive was in motion the whistle was affected by the Doppler effect caused by either the approach or retreat of the steam engine from the position of the observer. The sound the steam locomotive made when moving was also quite characteristic and in effect sounded like "chugga chugga, chugga chugga".

Certain electric trains and the like powered via a transformer and running on a track incorporate mechanisms which mimick the whistling sound of a steam locomotive. These trains, however, are propelled by electric motors and therefore do not mimick the chugga chugga sound of the steam locomotive. Further, prior art devices are not known which have the ability to simulate both a slow moving and a fast moving steam locomotive unless these prior art devices are extremely sophisticated and as such, not practical for incorporation into pre-school type toys.

BRIEF SUMMARY OF THE INVENTION

It is an object of this invention to produce a toy adapted for use by pre-school children which simulates a steam locomotive using both a visual and audio mode. Included in the audio portion of this is an apparatus for producing a sound mimicking a steam locomotive while it is moving, as well as an apparatus for mimicking the whistling sound made by a steam locomotive. It is an additional object to produce a toy which is capable of both visually and audibly mimicking a steam locomotive yet which is simple in construction and thus easy to manufacture and economic to the consumer.

These and other objects are achieved in a toy steam locomotive which comprises means for producing a sound simulating a steam locomotive; means for producing a sound simulating a steam locomotive whistle; means for producing a visual simulation of a fire in a steam locomotive firebox; power means operatively connected to said means for producing a sound simulating a steam locomotive, said means for producing a sound simulating a steam locomotive whistle, and said means for producing a visual simulation of a fire; switch means connected to said power means for turning said power means off and on; first control means operatively connected to said means for producing a sound simulating a steam locomotive whistle and capable of controlling said means for producing a sound simulating a steam locomotive whistle between an on position wherein said whistle sound is heard and an off position wherein said whistle sound is not heard; second control means operatively connected to said means for producing a sound simulating a steam locomotive for modulating said simulated steam locomotive sound.

The apparatus of the toy for producing a sound mimicking a steam locomotive comprises a resonator means located in said toy such that a portion of said resonator means is free to vibrate producing a sound audible outside of said toy; an activator means located in said toy and including a power means for continuously activating said activator means; a variable vibration means operatively associated with said resonator means such that vibration can be transferred from said variable vibration means to said resonator means for producing said sound; cycling means attaching to said variable vibration means and capable of cyclically associating and disassociating said variable vibration means with said activator means such that vibrations are induced in said variable vibration means when said variable vibration means is associated with said activator means and said vibrations are allowed to dissipate when said variable vibration means is disassociated from said activator means.

The apparatus of the toy for mimicking the whistling sound produced by a steam locomotive comprises a chamber having an air inlet and an air outlet, a fan means located in said chamber; a whistle means associated with said air outlet of said chamber; an inlet closure means associated with said air inlet and including a closure member capable of sealing said air inlet to ingress of air into said chamber, control means operatively connected to said closure member and capable of moving said closure member with respect to said chamber allowing air to ingress into said chamber and be propelled from said chamber by said fan means through said outlet into said whistle means.

The apparatus of the toy for mimicking the fire in the firebox of a steam locomotive comprises a housing having an opening simulating the opening of a firebox in a steam locomotive; a transparent member located in said opening in said housing, said transparent member including a first surface exposed through said opening in said housing and a second surface spaced from said first surface, said first surface containing a plurality of ridges, each member of said plurality of ridges lying essentially parallel to the other member of said plurality of ridges, said second surface comprising a flat planar surface; a movable member located adjacent to said transparent member and including a flat planar surface located adjacent to and coplanar with said second surface of said transparent member, said movable member movably mounted on said housing such that it is capable of oscillating back and forth with respect to said transparent member, said movable member including indicia located on said flat planar surface of said movable member, said indicia comprising at least two colors corresponding to different colors of a flame; means for oscillating said movable member with respect to said transparent member.

BRIEF DESCRIPTION OF THE DRAWINGS

This invention will be better understood when taken in conjunction with the drawings wherein.

Figure 1:
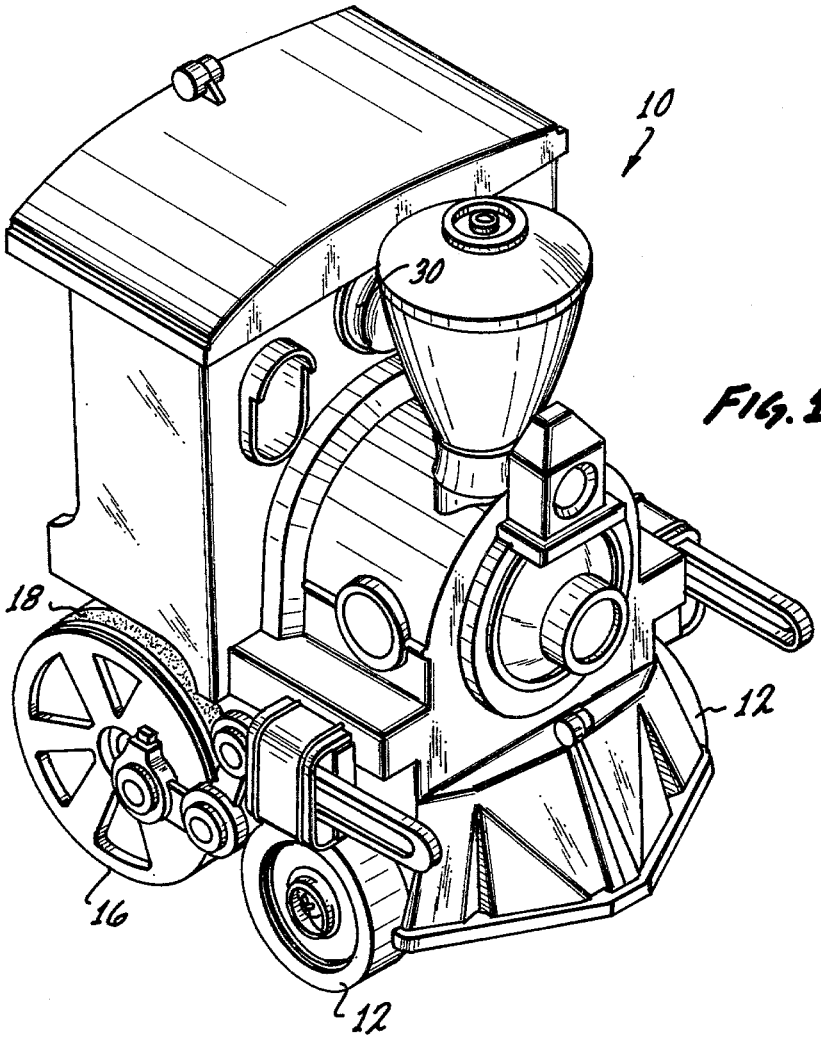
FIG. 1 is an isometric view of the toy steam locomotive of the invention.

The invention described in this specification and illustrated in the drawings utilizes certain principles and/or concepts which are set forth in the claims appended to this specification. Those skilled in the toy arts to which this invention pertains will realize that these principles and/or concepts could be used with a number of differently appearing embodiments without departing from the spirit and scope as set forth by the claims. For these reasons this invention is to be construed in light of the claims and is not to be construed as being limited only to those embodiments described in the specification and depicted in the figures.

DETAILED DESCRIPTION

The toy 10 shaped as a steam locomotive has a plurality of outside and internal housing parts, the exact description of which need not be described in order to understand this invention. For this reason only certain of the housing parts will be numbered and described.

A child playing with the toy 10 has a multiplicity of controls to operate allowing the child to simulate ringing of the bell of the locomotive, blowing the whistle of a locomotive, starting and stopping the locomotive with regard to movement along a surface, having the locomotive emit a chugga chugga sound, and being able to modulate this chugga chugga sound.

The toy 10 is rollably mounted via a set of front wheels, only one wheel 12 which is viewable in the drawings, and a set of rear wheels 14 and 16. Rear wheel 16 includes a rubber strip 18 around its circumference which engages the surface on which the toy 10 is located to propel the toy 10 forward. The driving mechanism of the toy as hereinafter explained drives rear wheel 16.

Figure 2:
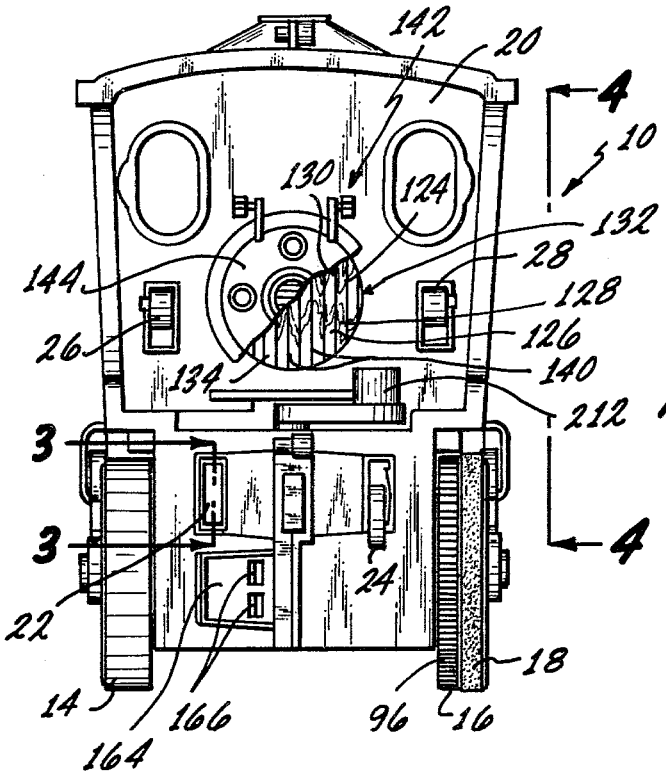
FIG. 2 is a rear elevational view of the toy steam locomotive shown in FIG. 1.

The controls for the different functions of the toy 10 are located at the rear 20 of the toy 10 as best seen in FIG. 2. The lower left-most control 22 is the off and on control. The right rear-most control 24 is the stop and go control. The upper left control 26 is the bell control and the upper right control 28 is the whistle control. A further control as hereinafter described controls the speed of the locomotive sound. These are all exposed for easy manipulation by a young child's finger.

Figure 8:
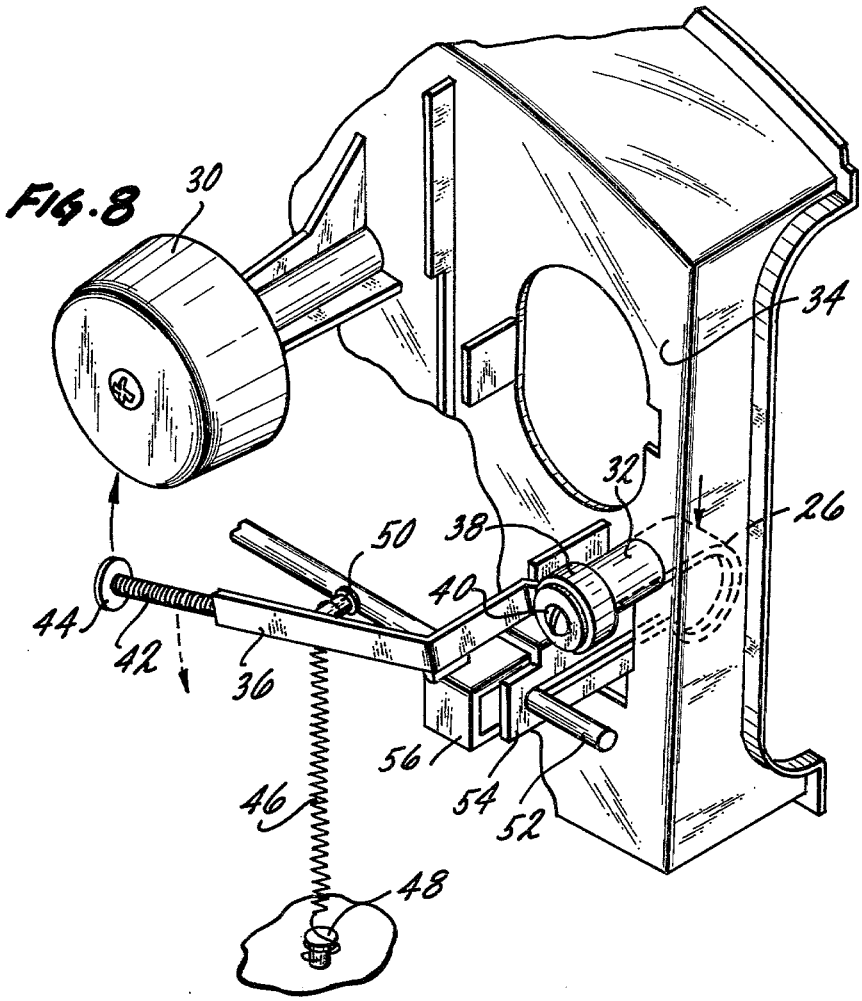
FIG. 8 is an isometric view of certain of the internal components of the toy steam locomotive of FIG. 1 which are located in the cab portion of the housing.

Referring now to FIG. 8 the bell 30 of the toy 10 is shown appropriately mounted on a housing component. A boss 32 projects outwardly from the inside of cabin panel 34 of the toy 10. A member 36 having two 90-degree bends includes a bearing 38 on one of its ends which slips over the end of boss 32. A flat-headed screw 40 retains the bearing 38 on the boss 32. A spring 42 is attached to the other end of the member 36 and includes a bell clanger 44 on its end. A spring 46 extends between a projection 48 located on a different portion of the housing of the toy 10 and a projection 50 located on member 36. The spring 46 biases member 36 downwardly away from the bell 30.

Figure 4:
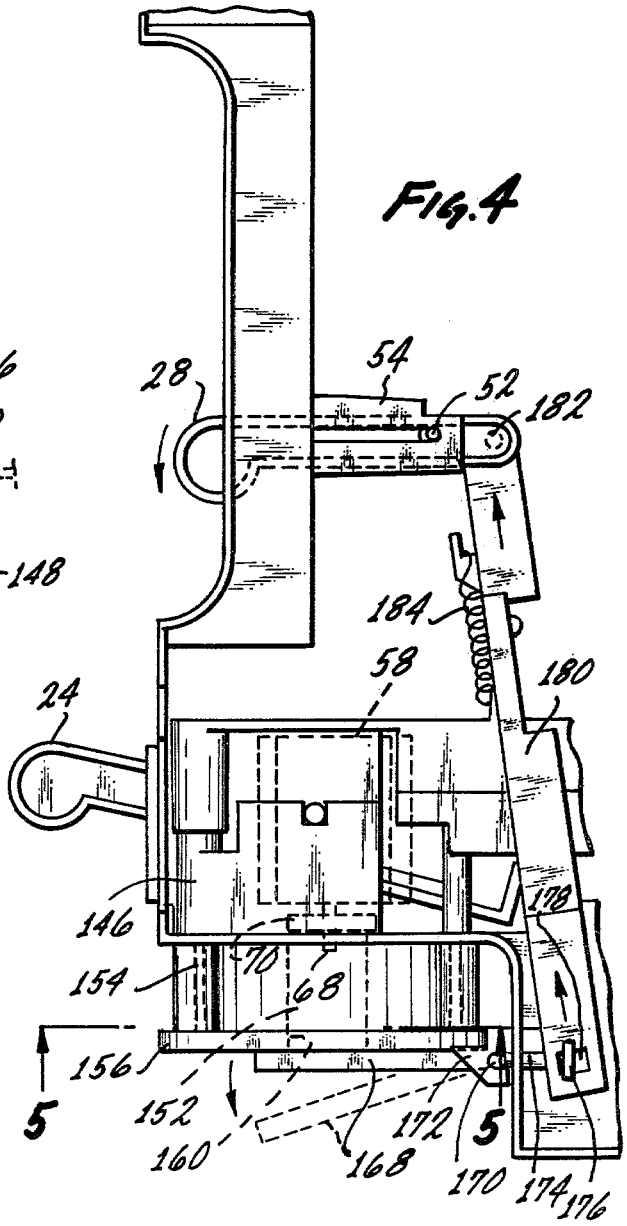
FIG. 4 is a side elevational view about the line 4—4 of FIG. 2.

An axle 52 extends between two identical projections collectively numbered by the numeral 54 extending outwardly from cabin panel 34. One of these projections is seen in FIG. 8 while the other is seen in FIG. 4. Pivotally mounted on axle 52 is bell control 26. End 56 of bell control 26 fits underneath member 36. When the other end of the bell control 26 is depressed by the user of the toy 10 the end 56 pivots member 36 upwardly about the bearing 38 against the bias of spring 46. This causes contact between bell clanger 44 and the bell 30 causing the bell 30 to ring.

Figure 3:
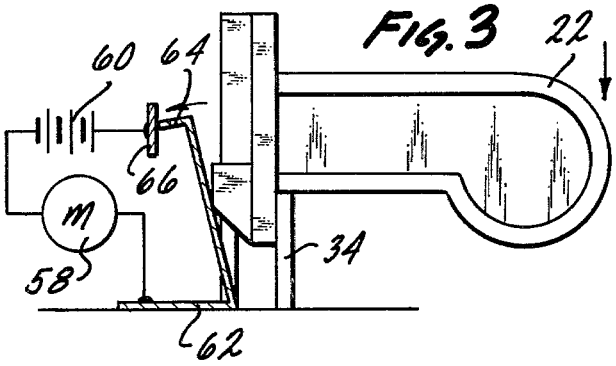
FIG. 3 is a side elevational view in partial section about the line 3—3 of FIG. 2.

Aside from the bell 30 the other functions of the toy 10 are all powered by a small electric motor 58 located within the interior of the toy 10. The motor 58 is powered by batteries not seen in the figures, but located near the bottom of the toy 10, but shown as electrical symbol 60 in FIG. 3. Off and on control 22 slides against the back surface of cabin panel 34. The off and on control 22 includes a projection 62 on its surface which interacts with a flexible metal contact 64. When the off and on control 22 is depressed, the projection 62 pushes a portion of metal contact 64 toward a second metal contact 66 until electrical contact between the two contacts 64 and 66 is made completing the electrical circuit to the motor 58 causing the same to rotate.

Attaching to the motor shaft 68 is a pinion 70. Pinion 70 meshes with spur gear 72 which is appropriately rotatably mounted within the interior of the toy 10. Integrally formed on the surface of spur gear 72 is a pinion 74. A disk 76 mounted on an axle 78 includes a spur gear 80 integrally formed on its lower surface. Spur gear 80 meshes with pinion 74 and thus the disk 76 is rotated by the motor 58.

Figure 6:
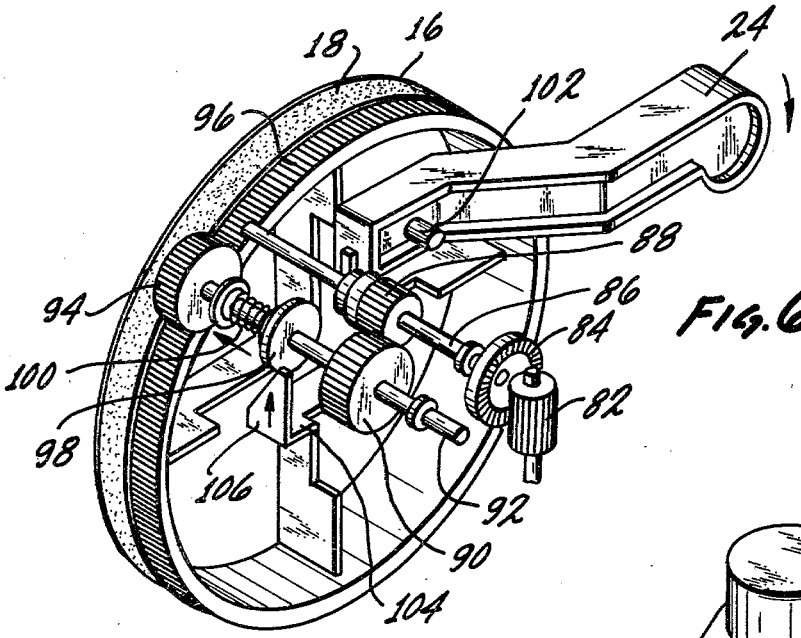
FIG. 6 is an isometric view of certain of the components within the interior of the toy steam locomotive which are adjacent to the right-hand wheel shown in FIG. 2.

A pinion 82 is located on axle 78 above disk 76. Pinion 82 inter alia, engages crown gear 84. Referring now to FIG. 6, crown gear 84 is seen fixedly attached to the end of axle 86. The axle 86 is appropriately journaled within the toy 10 on housing components, not shown in the drawings for the sake of simplicity of this specification. Other axles as hereinbefore and hereinafter described are also similarly journaled in housing members, also not shown or described for this same reason.

Fixedly located on axle 86 is a pinion 88 which engages with a pinion 90 fixedly located on axle 92. A second pinion 94 fixedly mounted on axle 92 is capable of engaging with gear teeth 96 extending around the periphery of rear wheel 16. Interspaced between pinions 90 and 94 and fixedly located on axle 92 is a disk 98. A spring 100 located around axle 92 biases disk 98 away from a housing component (not shown in FIG. 6) located between pinion 94 and spring 100. This biases axle 92 and therefore pinion 94 away from rear wheel 16 disrupting the engagement between pinion 94 and gear teeth 96. Stop-go control 24 is pivotally mounted to housing components (not shown) by axle 102. As seen in FIGS. 4 and 6, the stop-go control member 24 has an extension 104 which goes below both axles 86 and 92 and the gears located thereon, and includes a wedge 106 on its end. Wedge 106 is positioned to interact with disk 98. When the operator end of stop-go control 24 is depressed, the wedge 106 is elevated against the surface of disk 98 pressing the disk 98 and the axle 92 attached to it against the bias of spring 100. This moves pinion 94 into engagement with gear teeth 96 turning the rear wheel 16 to drive the toy 10 forward across a surface. When the stop-go control 24 is again raised, the wedge 106 descends from its engagement disk 98 allowing the spring 100 to disengage pinion 94 from gear teeth 96 discontinuing the forward movement of the toy.

Figure 11:
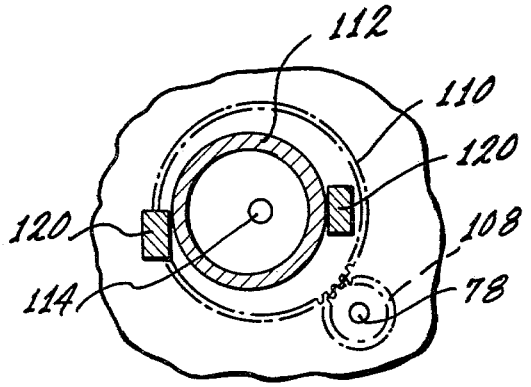
FIG. 11 is a plan view in section taken about the line 11—11 of FIG. 10.
Figure 10:
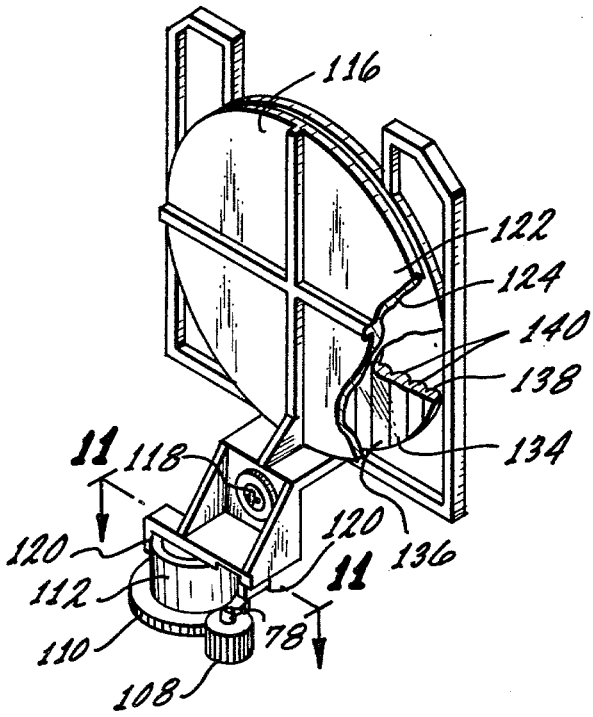
FIG. 10 is an isometric view of the back side of the firebox viewable in FIG. 2.
Figure 7:
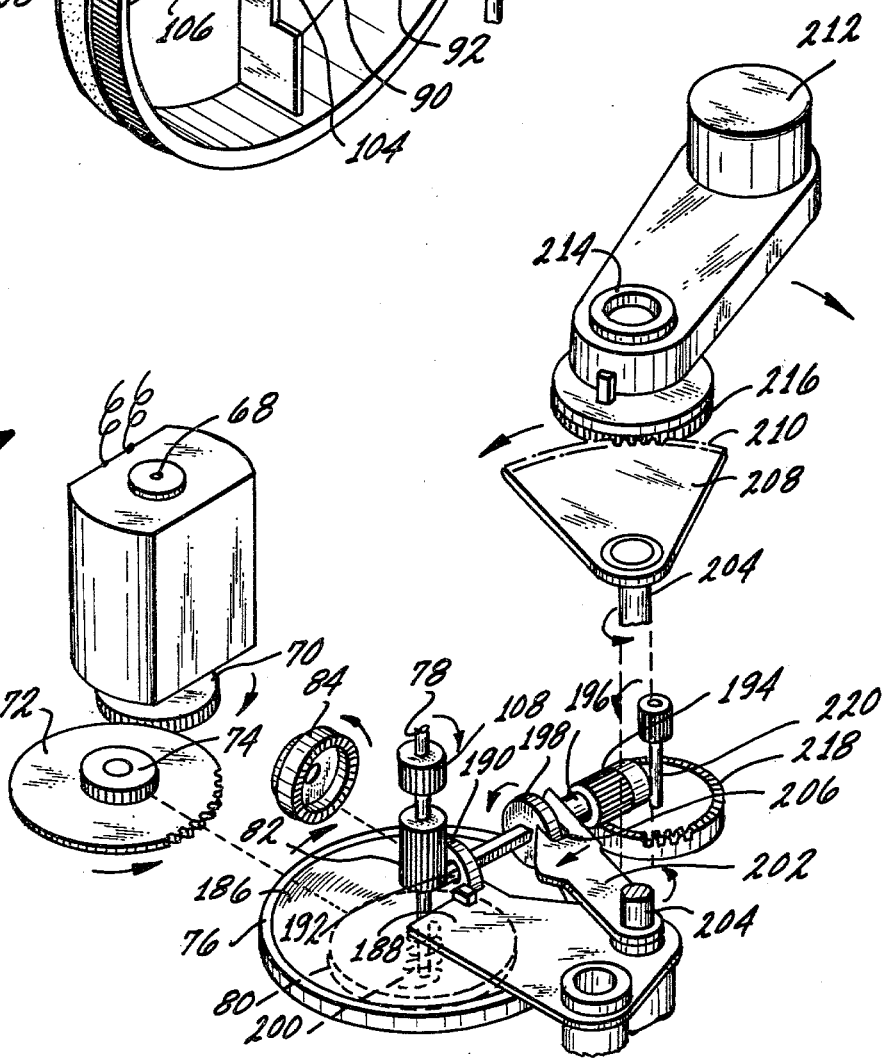
FIG. 7 is an exploded view of certain of the internal components of the toy steam locomotive including certain parts also shown in FIG. 6.

As seen in FIG. 7, a second pinion 108 is also located on axle 78. Referring now to FIGS. 10 and 11 pinion 108 engages spur gear 110. Integrally formed on the upper surface of spur gear 110 is an upstanding hollow cylinder 112. The cylinder 112 is not centered on spur gear 110, but is eccentrically located thereon. Spur gear 110 is located about boss 114 on a housing component (not shown or numbered) such that it can be rotated about boss 114 by pinion 108. When spur gear 110 rotates cylinder 112 moves in an eccentric manner about the boss 114.

A movable member 116 is rotatably mounted on the inside of cabin panel 34 by a flat-head screw 118. The portion of movable member 116 located below screw 118 includes two lugs collectively identified by the numeral 120. These lugs 120 fit about cylinder 112. As cylinder 112 eccentrically rotates, it first presses against one of the lugs 120 rotating movable member 116 about screw 118 in one direction and then presses against the other of the lugs 120 rotating the movable member 116 in the opposite direction. The net effect of this is that the upper rounded portion 122 of movable member 116 oscillates back and forth.

Rounded portion 122 of movable member 116 has a flat surface 124 which projects toward the cabin panel 34. As seen in FIG. 2 the surface 124 has a flame pattern on it. This flame pattern is composed of at least two colors, and preferredly three. Thus, the bottom 126 of the pattern is yellow, the midportion 128 is red, and the upper portion 130 is black. These represent three different heat zones within a flame.

Mounted within an opening 132 in cabin panel 34 is a transparent member 134. Transparent member 134 has a rear surface 136 which is flat and is coplanar with surface 124 on movable member 116. The other surface of transparent member 134—the exposed surface 138—has a plurality of semicylindrical ridges 140 on it. As the rounded portion 122 of movable member 116 oscillates back and forth behind the transparent member 134 the ridges 140 distort the colors 126, 128 and 130 on surface 124 giving the appearance of a flickering flame within the firebox 142 of the toy 10. A firebox cover 144 is appropriately hinged to cabin panel 34 and can be closed over the firebox 142 inhibiting the view of the flickering flame therein, or opened to allow the user of the toy to view the simulated fire within the firebox 142.

Figure 5:
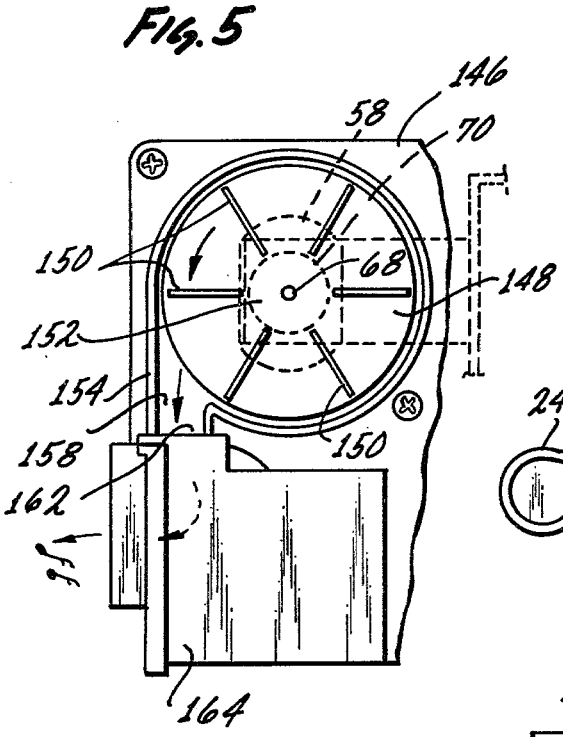
FIG. 5 is a bottom plan view about the line 5—5 of FIG. 4.

As seen in FIG. 5, motor 58 sits upon housing component 146. The shaft 68 of the motor 58 extends through the housing component 146 and into the center of fan disk 148. Fan disk 148 is located immediately below pinion 70 and is fixedly located on the motor shaft 68. Both the fan disk 148 and the pinion 70 are continually rotated whenever the motor 58 is energized. A plurality of fan blades collectively identified by the numeral 150 project downwardly and perpendicular to the fan disk 148. The fan blades 150 extend from the periphery of fan disk 148 toward the center of fan disk 148; however, they terminate before they reach the center leaving a central section 152 which is void of any fan blade 150.

An upstanding wall 154 projecting downwardly from housing component 146 forms almost a complete circle around the fan disk 148. The housing component 146, the wall 154 and a cover component 156 form a fan chamber 158. The fan chamber 158 includes an air ingress hole 160 located in cover component 156 directly over the center of fan disk 148 and an air egress hole 162 which essentially lies on a tangent to fan disk 148. Located adjacent to egress hole 162 is a whistle 164 having outlet holes 166. The whistle 164 includes appropriate baffles, chambers, etc. as is common with whistles and need not be described in detail to understand the invention.

A closure member 168 is pivotally hinged to cover component 156 by the interaction of an axle 170 with hinge members collectively identified by the numeral 172. An extension 174 of closure member 168 extends beyond axle 170. Extension 174 includes a key 176 which fits into hole 178 located in member 180. Whistle control 28 is pivotally mounted about axle 52 in a manner similar to that described for bell control 26. Member 180 pivotally attaches to whistle control 28 via axle 182 projecting from the whistle control 28. A spring 184 biases member 180 downwardly closing closure member 168 over ingress hole 160 in cover component 154. When whistle control 28 is depressed, it pivots about axle 52 lifting member 180 against the bias of spring 184 moving closure member 168 away from ingress hole 160.

As long as the off-on control 22 is positioned in the "on" mode such that motor 58 is turning, fan disk 148 and fan blades 150 are spinning. Normally closure member 168 seals ingress hole 160. The rotary movement of the fan blades 150 within the fan chamber 158 inhibits air movement within the chamber 158. Since ingress hole 160 is closed insufficient air to sound whistle 164 is moved through the fan chamber 158 and out egress hole 162 into the whistle 164. When the closure member 168 moves from its sealing position with ingress hole 160, sufficient air is allowed to flow through the fan chamber 158 into the whistle 164. The air flow to the whistle 164 builds up from near zero to a constant velocity governed by the size of ingress hole 160. This causes the whistle 164 to go from a very low pitch to a higher pitch as the closure member 168 moves away from the ingress hole 160. The net result is a whistle sounding very much like a steam locomotive whistle as modified by a Doppler effect.

A rubber disk 186 is located on the surface of disk 76. A support member 188 extends across the surface of disk 76 but does not touch it. Support member 188 includes a journal 190 on its end. An axle 192 is rounded at one end such that it fits into and can rotate in journal 190. Fixedly attached on the other end of axle 192 is a pinion 194 which also includes a bearing surface 196 on it. Bearing surface 196 is appropriately journaled in a housing component (not shown) in FIG. 7. A wheel 198 has a square hole (not separately numbered) allowing it to slidably fit on axle 192. Because of the square hole, any rotation of the wheel 198 is thus transferred to axle 192. Wheel 198, however, is not fixed to axle 192 but is free to slide along axle 192.

A compression spring 200 located underneath disk 76 biases disk 76, axle 78 and the pinion gears attached thereto in an upward direction. The limit of upward travel of disk 76 is governed by interaction between rubber disk 186 and wheel 198. Thus, wheel 198 frictionally engages disk 76. As a result of this, rotation of disk 76 is transferred to axle 192.

A shifting arm 202 is fixedly attached to shaft 204. Shifting arm 202 includes a slot 206 which engages about wheel 198. Shaft 204 is appropriately journaled in the housing of the toy 10 and its upper end is fixed to segment 208. Segment 208 includes a gear rack 210 on its periphery. A speed control 212 extends out of cabin panel 34 as seen in FIG. 2. As seen in FIG. 7 the speed control 212 is mounted to the housing of the toy 10. Integrally formed with speed control 212 and centered about bearing surface 214 is a spur gear 216 which engages gear rack 210. Arcuate movement of the speed control 212 is therefore transferred via segment 208 to shaft 204 to shifting arm 202. This causes wheel 198 to move along a radial line toward and away from the center of rubber disk 186. Depending on the location of wheel 198 on rubber disk 186 wheel 198 will spin faster or slower relative to movement of axle 78 and thus motor shaft 68. These components therefore comprise a power transfer means.

As noted before, pinion 194 is attached to axle 192. Pinion 194 engages crown gear 218 which is mounted on axle 220. The speed of rotation of axle 220 with respect to the speed of rotation of motor shaft 68 is governed by the location of wheel 198 on rubber disk 186. The operator of the toy therefore can control the speed of axle 220 and the components attached thereto as hereinafter explained by movement of the speed control 212.

Figure 9:
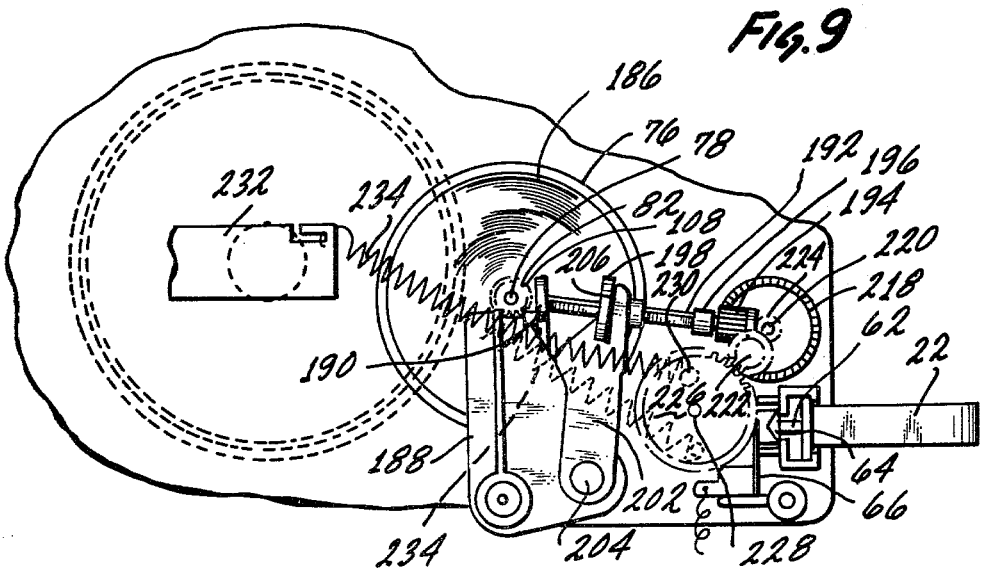
FIG. 9 is a top plan view showing certain of the components also seen in FIG. 7 and includes one of the components shown in one spatial relationship in solid lines and a second spatial relationship shown in phantom lines.
Figure 12:
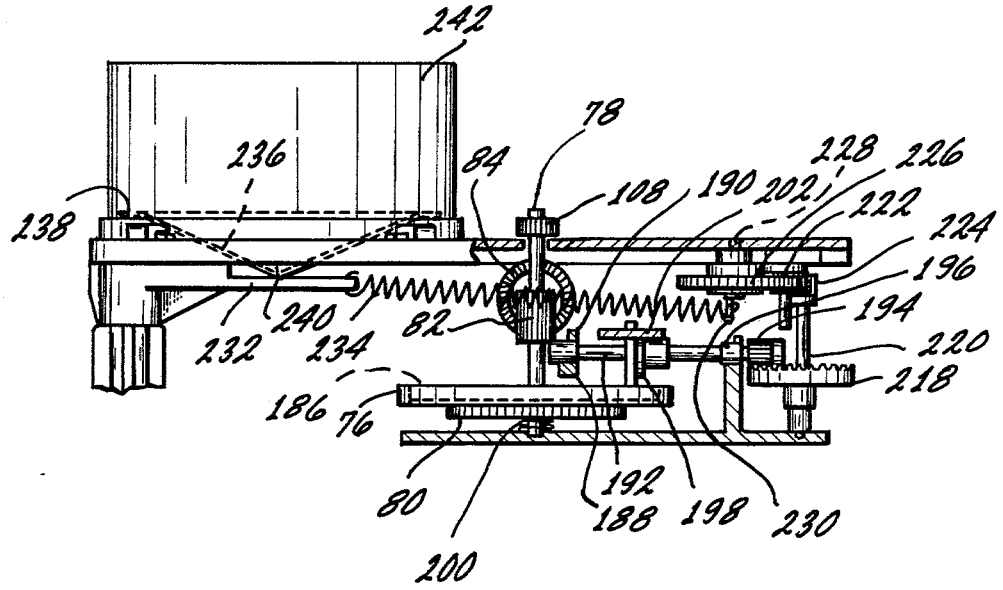
FIG. 12 is a side elevational view in partial section of certain of the components shown in FIG. 9.

Referring now to FIGS. 9 and 12, certain of the components as hereinbefore explained are viewable from a different angle than that shown in FIG. 7. A small pinion 222 appropriately journaled interacts with a pinion 224 attaching to axle 220. Pinion 222 also interacts with crank disk 226. Crank disk 226 is mounted on axle 228 allowing it to spin with respect to motion conveyed in the preceding paragraphs. A crank pin 230 projects from the surface of crank disk 226.

A vibration transfer member 232 is appropriately mounted within the interior of the toy 10. A spring 234 connects to both vibration transfer member 232 and crank pin 230. In the position shown in solid lines in FIG. 9 the spring 234 is forced against pinion 82 which serves as a striker means to cause spring 234 to vibrate. The vibrations of spring 234 are propagated along spring 234 and transferred to vibrational transfer member 232. In the position shown in phantom lines in FIG. 9 the crank disk 226 and therefore the crank pin 230 have been rotated 180 degrees. In this position the spring 234 no longer is engaged against the surface of pinion 82 and therefore is not caused to vibrate in respect to rotary motion of pinion 82. In this position any vibrational energy still stored in spring 234 is allowed to dissipate.

A resonator cone 236 is appropriately mounted in the interior of the toy 10 about its periphery 238. The apex 240 of resonator cone 236 makes contact with vibrational transfer member 232. As such, vibrations from spring 234 are transferred to vibration transfer member 232 and then to resonator cone 236. This causes resonator cone 236 to emit a sound in response to the vibrations. A resonator chamber 242 fits over the resonator cone 236 and serves to amplify the sounds emitted by the resonator cone 236.

By the gearing as heretofore described crank disk 226 is caused to rotate in a counterclockwise direction. Pinion 82 rotates in a clockwise direction. As such, pinion 82 engages spring 234, or in reality the individual coil turns or loops of the spring 234, and pushes them toward the vibration transfer member 232. As the individual surfaces on the pinion 82 are freed from the individual coils of the spring 234 the spring is allowed to recoil back toward the crank disk 226. This recoil movement is stopped as soon as the next tooth of the pinion 82 engages one of the coils of the spring 234.

When spring 234 is in contact with pinion 82, as the crank disk 226 rotates counterclockwise it shortens and relaxes the spring 234 continually changing the harmonics of the spring 234. As spring 234 shortens, its individual coils are brought closer together. Since the pinion 82 is rotating at a constant speed the shortening of the space between the individual coils of the spring 234 increases the number of individual coils with which each individual gear tooth on pinion 82 can theoretically contact per unit of length of the spring 234. When the spring 234 is stretched and tensed each gear tooth may only strike one coil as it rotates past the spring 234, but as the spring is shortened and relaxed each individual gear tooth may strike more than one cell. The vibrations in the spring 234 are therefore quite compound and complex because of the frequency of striking of the individual coils by the gear teeth of the pinion 82 in conjunction with the changing harmonics of the spring 234 brought about by the shortening and relaxing of the spring 234.

As the crank disk 226 rotates counterclockwise the spring 234 as shown in solid lines in FIG. 9 is engaged against the pinion 82. When the crank pin 230 is closest to the vibrational transfer member 232 the spring 234 is only loosely held against the surface of pinion 82. When the crank pin 230 approaches a position adjacent to the off-on control 22 as seen in FIG. 9 the spring 234 once again engages pinion 82. However, it is now elongated and tense. The rotation of crank disk 226 therefore serves to cyclically engage and disengage spring 234 with its striker means pinion 82.

The sound emitted from the toy 10 caused by the interaction of spring 234 with pinion 82 as modified by the movement of crank disk 226 results in a variable sound simulating the chugga chugga like sound of a steam locomotive. The child can increase or decrease the speed of this sound via speed control 212.

I claim:

1. A toy steam locomotive which comprises:

a housing;

means for producing a sound simulating a steam locomotive mounted on said housing;

means for producing a sound simulating a steam locomotive whistle mounted on said housing;

means for producing a visual simulation of a fire in a steam locomotive firebox mounted on said housing, said latter means including at least one member mounted for relative movement on said housing, the movement of said member simulating the flickering movement of a flame;

power means operatively connected to said means for producing a sound simulating a steam locomotive, said means for producing a sound simulating a steam locomotive whistle, and said means for producing a visual simulation of a fire;

switch means connected to said power means for turning said power means off and on;

first control means operatively connected to said means for producing a sound simulating a steam locomotive whistle and capable of controlling said means for producing a sound simulating a steam locomotive whistle between an on position wherein said whistle sound occurs and an off position wherein said whistle sound does not occur;

second control means operatively connected to said means for producing a sound simulating a steam locomotive for modulation of said simulated steam locomotive sound .

2. The toy steam locomotive of claim 1 wherein:

said means for producing a sound simulating a steam locomotive comprises a resonator means located on said housing such that a portion of said resonator means is free to vibrate producing a sound audible outside of said toy;

an activator means located on said housing and including a power means for continuously activating said activator means;

a variable vibration means located on said housing operatively associated with said resonator means such that vibration can be transferred from said variable vibration means to said resonator means for producing said sound;

cycling means attaching to said variable vibration means and capable of cyclically associating and disassociating said variable vibration means with said activator means such that vibrations are induced in said variable vibration means when said variable vibration means is associated with said activator means and said vibrations are allowed to dissipate when said variable vibration means is disassociated from said activator means; and said means for producing a sound simulating a steam locomotive whistle comprises a chamber located on said housing, said chamber having an air inlet and an air outlet, a fan means located in said chamber;

a whistle means associated with said air outlet of said chamber;

an inlet closure means associated with said air inlet and including a closure member capable of sealing said air inlet to ingress of air into said chamber, control means operatively connected to said closure member and capable of moving said closure member with respect to said chamber allowing air to ingress into said chamber and be propelled from said chamber by said fan means through said outlet into said whistle means; and said means for producing a visual simulation of a fire in a steam locomotive firebox comprises said housing having an opening simulating the opening of a firebox in a steam locomotive;

a transparent member located in said opening, said transparent member including a first surface exposed through said opening in said housing and a second surface spaced from said first surface, said first surface containing a plurality of ridges, each member of said plurality of ridges lying essentially parallel to the other member of said plurality of ridges, said second surface comprising a flat planar surface;

a movable member located adjacent to said transparent member and including a flat planar surface located adjacent to and parallel with said second surface of said transparent member, said movable member movably mounted on said housing such that it is capable of oscillating back and forth with respect to said transparent member, said movable member including indicia located on said flat planar surface of said movable member, said indicia comprising at least two colors corresponding to different colors of a flame;

means located on said housing for oscillating said movable member with respect to said transparent member.

3. A sound producing apparatus for a toy which comprises:

a resonator means located in said toy such that a portion of said resonator means is free to vibrate producing a sound audible outside of said toy;

an activator means located in said toy and including a power means for continuously activating said activator means;

a variable vibration means located in said toy and means associating it with said resonator means such that vibration can be transferred from said variable vibration means to said resonator means for producing said sound;

cycling means located in said toy and including means associating said cycling means with said power means whereby said power means moves said cycling means in a cyclic manner;

said variable vibration means attaching to said cycling means, said variable vibration means cyclically associating and disassociating with said activator means in response to said cyclic movement of said cycling means such that vibrations are induced in said variable vibration means when said variable vibration means is associated with said activator means and said vibrations are allowed to dissipate when said variable vibration means is disassociated from said activator means.

4. The apparatus of claim 3 wherein:

said variable vibration means is an elongated body capable of flexing longitudinally, one end of said elongated body operatively associated with said resonator means and the other end of said elongated body operatively associated with said cycling means.

5. The apparatus of claim 4 wherein:

said cycling means is capable of elongating and shortening said flexible elongated body.

6. The apparatus of claim 4 wherein:

said cycling means is capable of increasing and decreasing the tension in said elongated body.

7. The apparatus of claim 5 wherein:

said cycling means is capable of increasing and decreasing the tension in said elongated body.

8. The apparatus of claim 4 wherein:

said cycling means includes a crank disk rotatably mounted in said toy and including a crank pin located on said crank disk;

the other end of said elongated body attaching to said crank pin.

9. The apparatus of claim 8 including:

power transfer means operatively connecting said crank disk with said power means such that said crank disk is rotated in said toy by said power means.

10. The apparatus of claim 9 wherein:

said power transfer means includes a crank disk speed varying means for varying the rotation of speed of said crank disk.

11. The apparatus of claim 10 wherein:

said elongated body is an elongated spring;

said crank disk cyclically elongating and tensing said spring and shortening and relaxing said spring and concurrently disassociating and associating said spring with said activator means.

12. The apparatus of claim 11 wherein:

said activator means comprises a striker means having a plurality of projections on the surface of said striker means, said striker means rotatably mounted in said toy and capable of being rotated by said power means such that when said elongated spring is associated with said striker means the rotation of said striker means causes said plurality of projections on the surface of said striker means to contact said spring inducing vibrations in said spring.

13. The apparatus of claim 12 wherein:

said spring is physically contacted with said striker means as said spring is shortened and relaxed such that the number of coils of said spring in a unit of length in contact with said striker means is increased for a period of the cycle wherein said spring is in association with said striker means resulting in the vibrations transferred to said resonator means varying as a result of shortening of said spring, relaxing said tension of said spring and increasing the number of contacts between said plurality of projections and the number of coils of said spring in a unit of length.

14. The apparatus of claim 13 wherein:

said resonator means comprises a cone, said cone being mounted in said toy about the periphery of the base of said cone;

said resonator means including a vibration transfer member mounted in said toy, the apex of said cone contacting said vibration transfer member;

said spring connecting to said vibration transfer member.

15. An apparatus for producing a whistling sound which comprises:

a chamber having an air inlet and air outlet, a fan means located in said chamber;

an independent whistle means associated with said air outlet of said chamber;

an inlet closure means associated with said air inlet and including a closure member capable of sealing said air inlet to ingress of air into said chamber, control means operatively connected to said closure member and capable of moving said closure member with respect to said chamber allowing air to ingress into said chamber and be propelled from said chamber by said fan means through said outlet into said whistle means;

said fan means comprising a disk rotatably mounted within the interior of said chamber and including a plurality of fan blades extending perpendicular to said disk from the outer perimeter of said disk toward the center of said disk;

said outlet of said chamber being located beyond the periphery of said disk, said inlet in said chamber being located directly over the central section of said disk;

said closure member comprising a flat plate hinged on said chamber and movable between a position wherein said flat plate is located over said inlet to a position wherein said flat plate is removed from said inlet.

16. An apparatus for producing a visual simulation of a fire in a steam locomotive firebox which comprises:

a housing having an opening simulating the opening of a firebox in a steam locomotive;

a transparent member located in said opening in said housing, said transparent member including a first surface exposed through said opening in said housing and a second surface spaced from said first surface, said first surface containing a plurality of ridges, each member of said plurality of ridges lying essentially parallel to the other member of said plurality of ridges, said second surface comprising a flat planar surface;

a movable member located adjacent to said transparent member and including a flat planar surface located adjacent to and parallel with said second surface of said transparent member, said movable member movably mounted on said housing such that it is capable of oscillating back and forth with respect to said transparent member, said movable member including indicia located on said flat planar surface of said movable member, said indicia comprising at least two colors corresponding to different colors of a flame;

means for oscillating said movable member with respect to said transparent member.

* * * * *